United States Patent [19]

Bullard

[11] 4,166,427

[45] Sep. 4, 1979

[54] TIGHTENING AND SECURING CABLES HOLDING BARGES TOGETHER

[75] Inventor: Jack R. Bullard, Louisville, Ky.

[73] Assignee: American Commercial Lines, Inc., Houston, Tex.

[21] Appl. No.: 844,478

[22] Filed: Oct. 21, 1977

[51] Int. Cl.[2] ..... B63B 21/56

[52] U.S. Cl. ..... 114/251; 24/134 N; 114/199; 254/73; 254/135 R

[58] Field of Search ..... 114/199, 251, 252, 253, 114/254, 230; 24/134 N; 254/135 R, 161, 164, 73, 76, 67; 403/59, 62

[56] References Cited

U.S. PATENT DOCUMENTS

| | | | |
|---|---|---|---|
| 547,716 | 10/1895 | Day | 254/164 |
| 1,591,344 | 7/1926 | Reeves | 24/134 N |
| 2,148,284 | 2/1939 | White | 114/199 |
| 3,292,567 | 12/1966 | Blackburn | 114/251 |
| 3,483,841 | 12/1969 | Blackburn | 114/251 X |
| 3,824,653 | 7/1974 | Sholler | 254/135 R X |

*Primary Examiner*—Stephen G. Kunin
*Assistant Examiner*—Sherman D. Basinger
*Attorney, Agent, or Firm*—Laurence R. Brown

[57] ABSTRACT

By grasping a steel cable with a low cost portable self-tightening clamp that increases its holding force as the tensile pull force increases, one man can tighten steel cables of various lengths having bitter ends by using temporarily a single portable ratchet jack assembly to exert about 20 tons (20,000 KG) tightening force. Two similarly acting inexpensive clamps affixed to a barge deck hold the cable lines of various lengths without eyes in the end taut enough to bind barges together into one stiff unitary assembly, and permits the single ratchet (and portable clamp) assembly to be reused, thereby significantly reducing equipment inventory and cost.

14 Claims, 13 Drawing Figures

TIGHTENING AND SECURING CABLES HOLDING BARGES TOGETHER

Figure 1:
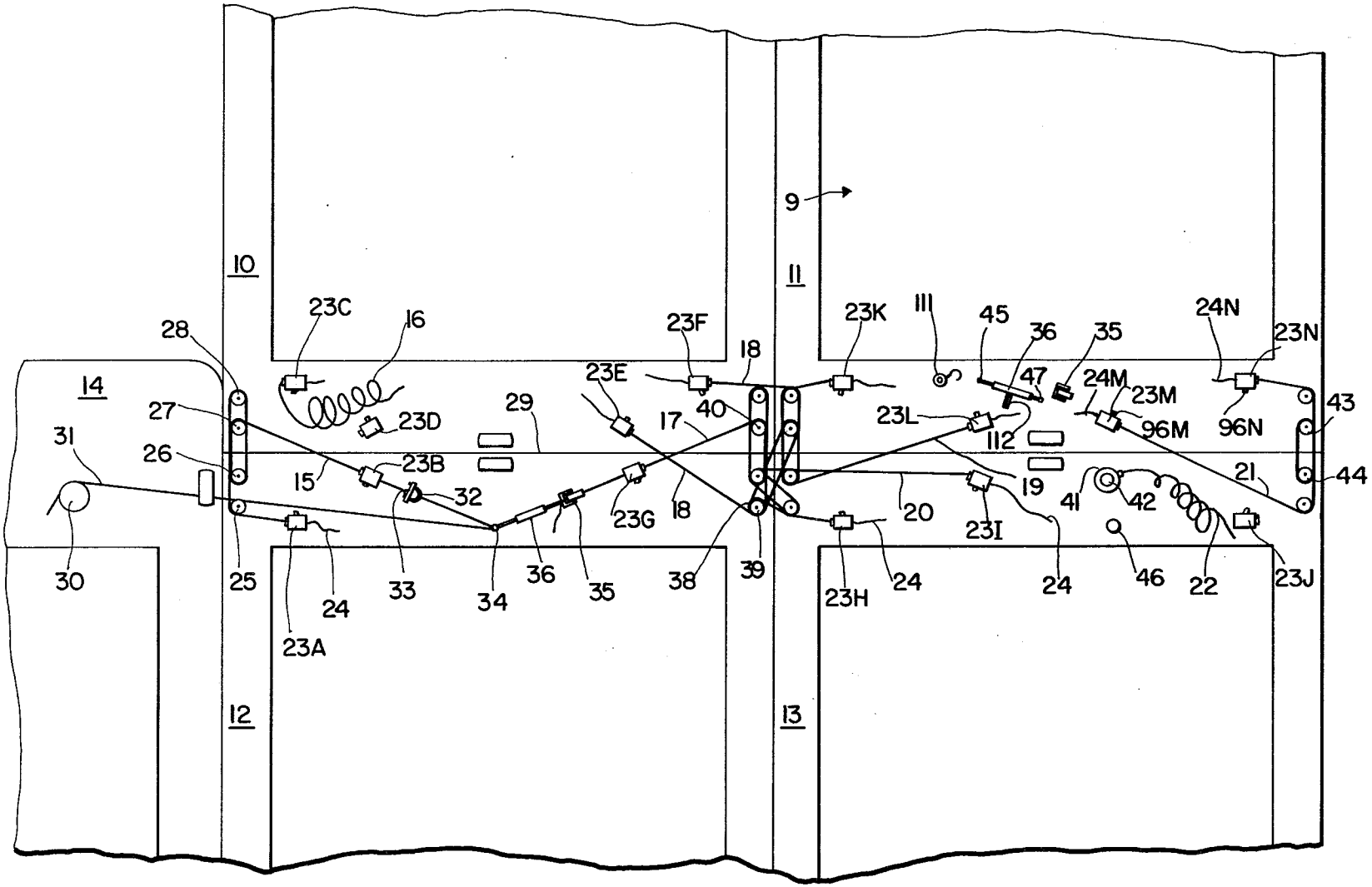

This invention relates to methods of and apparatus for tightening and cinching steel cables between two fixtures and more particularly it relates to securing a plurality of barges together into a single unit by taut cable rigging.

BACKGROUND OF THE INVENTION

Many problems exist in rigging cables to secure barges together, including the following:

One man has difficulty handling cables to wrap in place about fittings on two adjacent barges and pull tight enough to fasten manually onto a tightening ratchet jack of limited span to hold multiple barges stiffly as a single unit. When eyes are in the cable ends for hooking about fittings, then the cable is not as flexible and becomes more awkward to place and wrap by kinking. Also, these eyes when handled on a free end of cable can foul or get caught on deck projections, etc. Furthermore, such eyes must be placed in a cable by hand splicing which requires special steel fids and clamps, or by a hydraulic press.

When two eyed ends are used, the cables need a certain length and the eyes are not usually the same size. If one end is bitter, then it must be clamped near the end by prior art winch type wedges and if there is excess cable length, it is then necessary to place and store extra non-used cable intermediate the ends such as by coiling on a winch in order to achieve the desired tightness.

There is no known prior art way to handle and use various length cables with both ends bitter for binding barges together. Even when one end is bitter and is clamped to a fitting or winch the cable must be bent so acutely in the prior art clamping devices that it is difficult to handle by one person. While some tolerances in cable lengths might be compensated for in using a selectable number of chain links for coupling a pelican hook on an adjustable ratchet jack to a cable eye, this process leaves excess chain and requires expensive eyes, chains and hooks permanently lodged in the rigging. Also, when tightened by the eye method this requires a tightener ratchet jack to become permanently a part of the rigging for each cable used, resulting in a large inventory of ratchets.

If one bitter end is wound on a winch, which is of itself expensive, an extra length of cable is necessary for securing several turns about the winch drum, thus increasing cable length and cost. The winches generally welded to barge decks, if inoperable, are difficult to service and replace, thus leaving equipment including cables with eyes, ratchet jack, chain links, no fail-safe secondary securing method other than by use of extra shackles, and pins.

Also in prior art rigging various deck hooks or fittings need be provided for cable eyes, ratchet moorings, etc. The only feasible prior art ways to keep the cables tight have been to leave the tightener ratchets and winches in place. Replacement is difficult and expensive.

Barges also have to be maneuvered into exact place and squared away for securing the cables about deck fittings in order to tighten the cables enough to provide a watergoing single unit. Even then the cable tautness that can be achieved by one person is not generally sufficient because of the limited tightening range, the handling of the loops and variously located fittings that need be processed. It has been difficult for a single man to handle some of the heavy rigging equipment alone, particularly if tugs need to move and square away the barges. Heretofore, it has been substantially impossible for a single person to exert forces sufficient to pull approximately squared away barges closer together into one stiff unit while tightening cables, even when using large and expensive winches, which furthermore need maintenance and have a tendency to foul cable on drums which must be carefully wound and layered from a single direction, thereby preventing effective use of tensile force over different pull angles. Most prior art rigging such as winches permit cables to be pulled only in a single direction with little variance in the pulling angle, and if reeled need be handled precisely in a winding pattern.

Also, it is desirable to remove as many deck obstacles and attachments as possible to reduce possibilities of injury in handling, manipulating and tightening cables.

Thus, the cost of equipment and rigging manpower is high in the prior art and the many problems presented have complicated the rigging and caused failures in rigging of barges together. Similar problems exist in other applications requiring cables held under tension between two fixtures for binding loads or securing objects together.

In the prior art, cables have been grasped and retained by clamping devices which tighten the grip on the cable as the pulling tension is increased, as shown in U.S. Pat. Nos. 453,378 to G. W. Rowley, June 2, 1891; 1,460,276 to J. A. Robertson, June 26, 1923; and 3,934,855 to W. W. Patterson et al., Jan. 27, 1976. Some of these clamps have the advantage of feeding a bitter cable end straight through the clamp and securing the clamp at any variable position therealong. They are also advantageous in permitting the cable to freely pass by movement in one direction and to be gripped by movement in the opposite direction.

Barges have been secured together conventionally by cables wrapped about deck fittings where each cable is secured by special tightener ratchets or winches permanently secured to the barge deck, as shown in U.S. Pat. Nos. 3,105,675 to W. L. Blackburn, Oct. 1, 1963; 3,785,324 to H. A. Guthans, Jan. 15, 1974; and 3,292,567 to W. L. Blackburn, Dec. 20, 1966.

OBJECTS OF THE INVENTION

A general object of this invention is to provide improved cable tightening and securing methods and apparatus correcting one or more problems of the prior art as those aforesaid.

A more specific object of this invention is to provide improved methods and apparatus for securing a plurality of barges together into a single stiff unit.

Another object of the invention is to reduce cost and complexity of rigging securing barges together.

Yet another object of the invention is to reduce the manpower, cost, inconvenience and safety risks in securing barges together.

Other more specific objects of the invention include the provision of: (a) a less directional cable clamping mechanism, (b) a less critical cable tightening method, (c) the method of using cables with bitter ends and of various lengths to secure barges together, (d) the provision of rigging operable by a single person with enough force exerted and tightening range even to align and square barges for coupling together, and (e) to reduce the eight, cost and inventory of portable equipment used in rigging barges together.

BRIEF DESCRIPTION OF THE INVENTION

These and further objects, features and advantages are achieved by using a portable, self-tightening cable clamp for gripping a cable with at least one bitter end and coupling to the clamp a hand manipulated tightening jack assembly to hold the cable in tightened position for securing tautly in place by a resident fixed position cable clamp so that the portable rigging can be removed and used for rigging other cables. Thus, the rigging for each cable can simply consist of two inexpensive cable clamps secured to the barge decks for holding bitter opposite ends of a cable wrapped around barge mounted fittings located on two adjacent barges. The cable clamps are low in profile on the barge deck, permit significant variations in pulling angle from a fixed position and are easily maintained and simple to construct. The portable tightening clamp and jack are easily carried and manipulated by one person along with any length of cable without eyed ends to provide in the order of 20,000 KG tension in the cables.

THE DRAWING

Figure 1A:
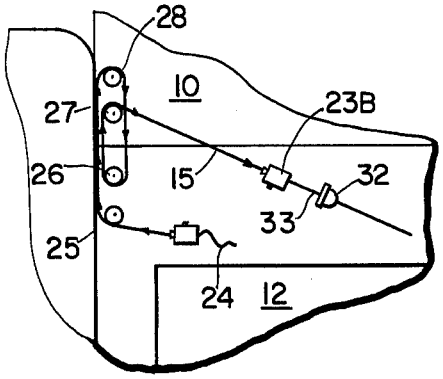
Figure 1B:
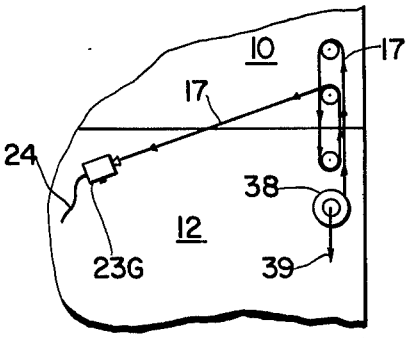
Figure 1C:
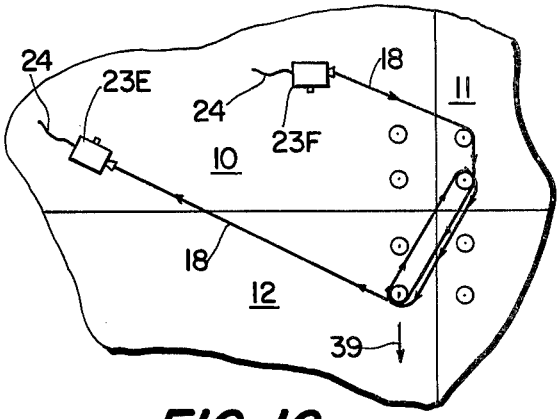
Figure 1D:
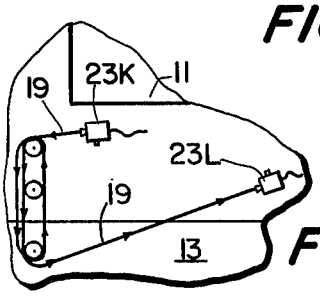
Figure 1E:
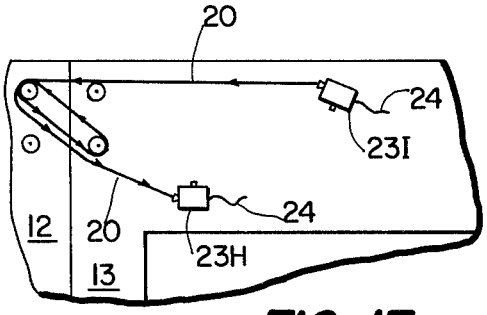
Figure 1F:
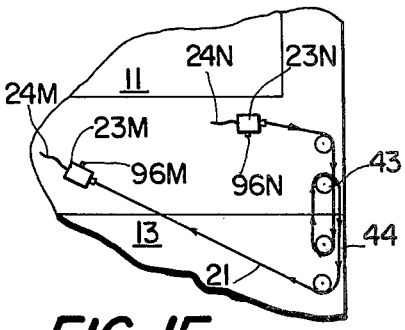
Figure 3:
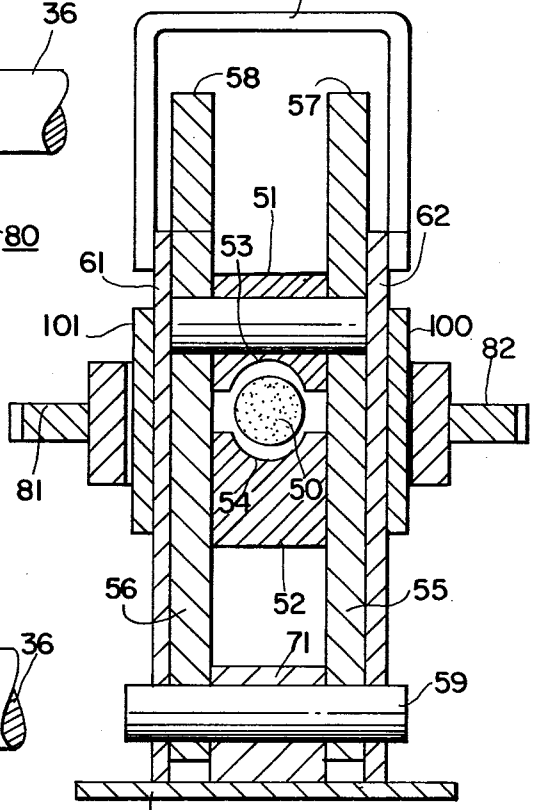
Figure 2:
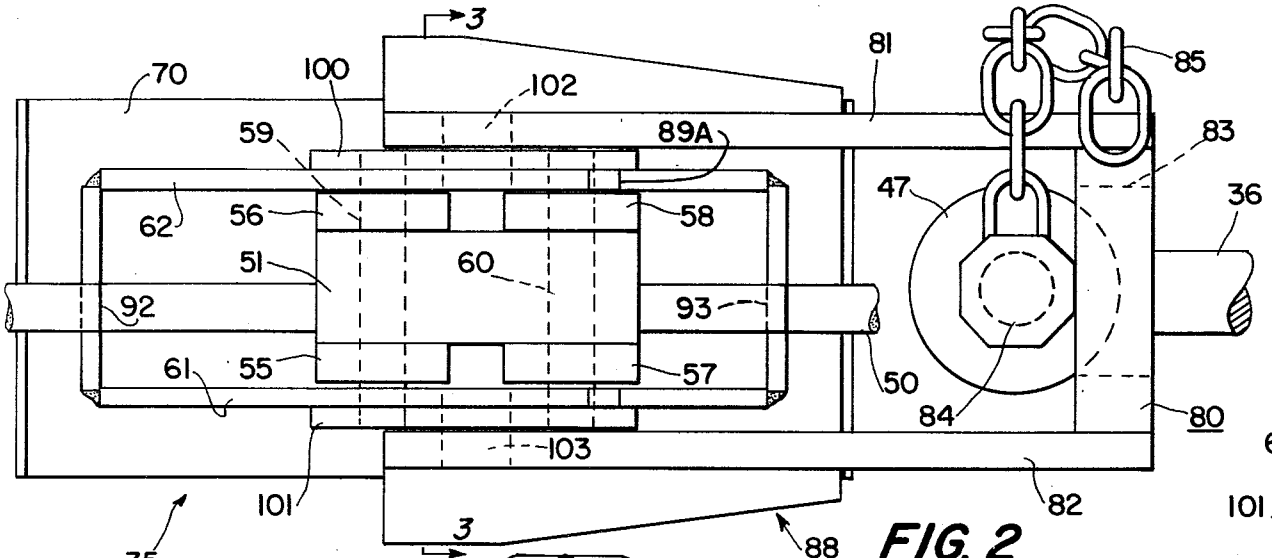
Figure 4:
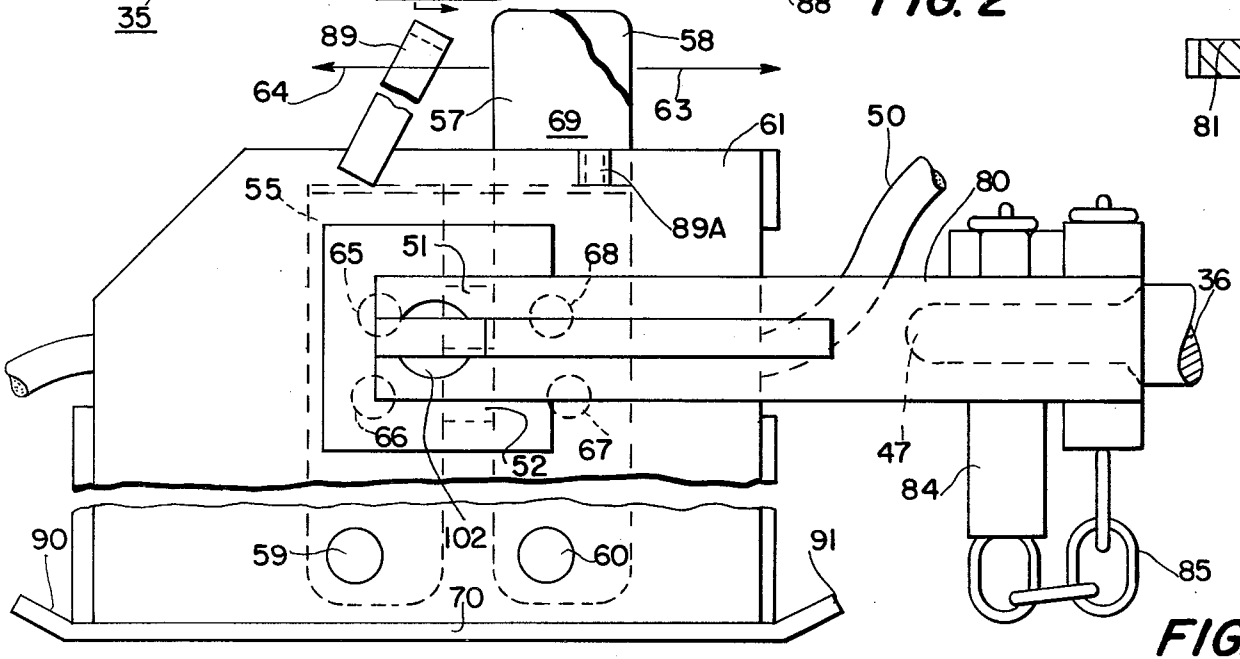
Figure 6:
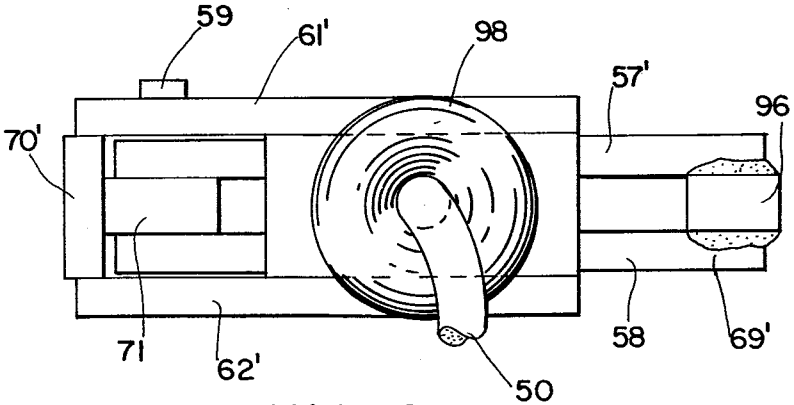
Figure 7:
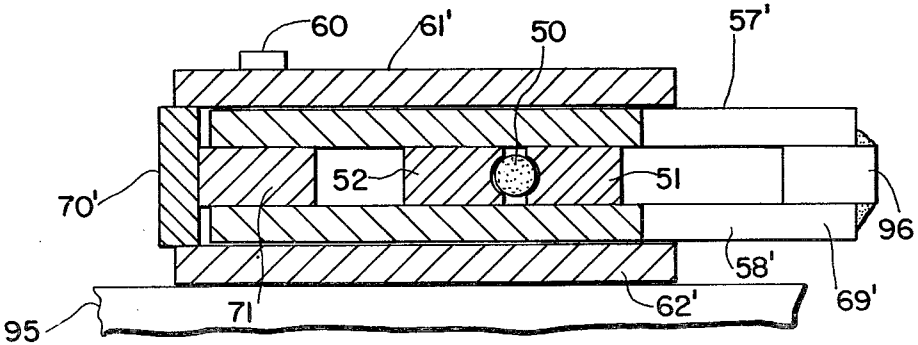
Figure 5:
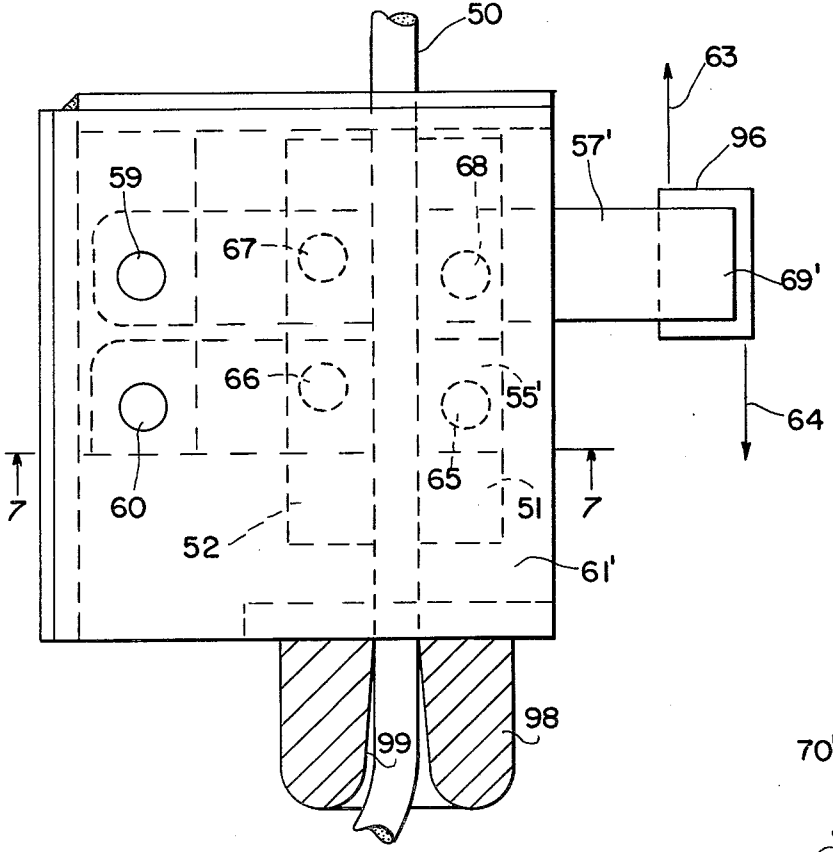

A more detailed description follows, with reference to the accompanying drawing, wherein FIG. 1 is a plan view sketch of coupling a plurality of barges with a boat alongside using the electric powered capstan to tighten a wire by the method of this invention;

FIGS. 1A, B, C, D, E, F, respectively, are enlarged portions showing the winding pattern of cables 15, 17, 18, 19, 20 and 21;

FIGS. 2, 3 and 4 are respectively top, end in section along lines 3—3 of FIG. 2, and side elevation views of a portable cable clamp afforded by this invention; and FIGS. 5, 6 and 7 are respectively a plan view partly in section, a front view, and a side elevation view as welded to a deck token in section along lines 7—7 of FIG. 5, of a fixed location cable clamp assembly afforded by this invention.

THE DETAILED DESCRIPTION

Referring now to the drawing of FIG. 1, four barges 10, 11, 12 and 13 are rigged together as one unitary solid vessel with pusher boat or tug 14 alongside by means of cable rigging about various deck fittings. Holds 9 are for cargo. For each of the cables 15–22 there is at least one corresponding clamp 23A, B, etc. welded to the barge deck for clamping holding a bitter (uneyed) end such as 24 of the cable securely in place. The unilateral operation of these clamps will be explained hereinafter.

In most cases two bitter ends 24 of a single cable such as 15 are held by a pair of clamps such as 23B, 23A welded to the deck of a single barge 12, and the cable is wound around buttons or fittings 25, 26, 27, 28, etc. located on two adjacent barges for tightly binding the barges together. Thus, cable 15 is wrapped from a first fixed reference position at clamp 23B around fitting 27 and 26 and back about 28 and out around 25 to clamp 23A, thereby to draw barge 10 against barge 12 squarely with common edge dividing line 29 shared therebetween. In this instance the cable 15 is tightened in tension by the capstan or winch 30 on the deck of boat 14 by means of capstan line 31 secured by hasp 32 to an eye 33 in one end of cable 15 as applied about a deck fitting 34 against clamping action on the cable clamp 23A and passing freely through clamp 23B until appropriate tautness is reached and it is locked in clamping position to hold the cable 15 in place. Thus, cable 15 has one eyed or looped end 33 and one bitter end 24.

Cable 21 is fixed in place by the same method, but having two bitter ends, is grasped by a portable clamp 35 and tightened by a manually operated portable ratchet tightener jack 36 which may be used to tighten, cinch and secure the various cables 15 to 22 about deck fittings to secure the barges together as fore, aft, breast and jockey cables. Thus, cables 18 and 20 are jockey cables and cables 19 and 21 are fore and aft cables.

Significant advantages of the use of cable clamps 23 include (1) the ability to work with cables having one or two undressed bitter ends 24 which permit easier manual handling without kinking or catching on undesired deck protuberances, (2) the use of cables of undefined or arbitrary lengths which let the free ends 24 pass through the clamps, (3) reduction of fittings, eyes, chains and tightener jacks 36 (one portable clamp 35 and tightener jack 36 only being necessary for an entire bound rig of boat and a plurality of barges), (4) the ability of one man to handle the entire rigging alone, even drawing barges together for squaring and mating by means of the cables about fittings on two different barges, and (5) a particular advantage is that the portable clamp can be set at any cable position without adjusting chains, pelican hooks or other take-up fittings.

As shown at the bitter end of cable 17 on barge 12, the cable is tightened by manually operating jack 36 coupled to a fixed reference point on the deck at fitting 34, while portable clamp 35 pulls in tension against an eye 38 about afixed reference position at deck fitting 39 in the unilateral free pass direction through clamp 23G. This eliminates the need of a clamp (23, etc.) to hold a bitter end of the cable. When taut enough clamp 23G is locked against cable 17 tension pull toward fitting 40 with a clamping action that increases in force as the tension increases thereby resisting any release should forces from relative movement of the various barges tend to pull the cable 17 loose from clamp 23G. In this instance the jack 36 is affixed to deck fitting 34 for tightening purposes, and in this example is left in place as a storage of a spare. In the prior art every cable required a tightening jack to be left in place, and in the method of this invention using the apparatus of this invention only one such jack is necessary for all cables and it need not be left in place, although one such as shown here is useful as a spare for that aboard barge 11 in the event of failure.

As shown by cable 22 with eye 41 in one end about fitting 42, if desired a single deck clamp 23J may be used for each cable at the expense of a single eyelet. The cable would be wound about fittings 43, 44, etc. and passed through deck clamp 23J and grasped by the bitter end with portable clamp 35 and tightened by portable jack 36 with eyelet 45 attached to deck fitting 46 in the manner aforedescribed. The remaining jack eyelet 47 will be affixed to portable clamp 35 in the manner later described (FIG. 2).

A cable 16 with both ends bitter as shown on barge 10 is similarly secured and tightened using two deck clamps 23C and 23D to attain a mounted posture similar to cable 21 attached to deck clamps 23M and 23N on barge 11. It is therefore seen that barges are secured together by tightening and cinching cables held by unilaterally operating cable clamps on the deck and that bitter free ends of cables are grasped and tightened by means of a similarly acting portable clamp to thereby simplify rigging, reduce manpower, and secure barges more tightly together in a seaworthy manner as one single stiff unitary vessel.

The construction and operation of the portable clamps 35 for clamping and holding a cable 50 is illustrated by consideration of FIGS. 2 to 4. The lever 89 seen in FIG. 4 is not shown in FIG. 2 for purpose of clarity. In general, the cable 50 is axially longitudinally passed through a set of two pivotally movable cable clamping jaws 51, 52 substantially rectilinear in form with indented segments approaching semi-cylindrical form as axial indentations 53, 54. The pivoting of jaws 51, 52 by lever sets 55, 56 and 57, 58 gives unilaterial clamping action on the cable 50 by opening the jaws to let the cable freely axially pass through the cylinder defined by 53, 54 as the cable 50 moves axially through in the direction into FIG. 3 and to the right in FIGS. 2 and 4. Conversely the jaws 51, 52 move together to clamp the cable therebetween and grip it in a self-tightening mode with a force proportional to the tension pull on cable 50 from the left in FIGS. 2 and 4 as it passes in the opposite axial direction. Thus, the jaws 51, 52 never quite close as seen from FIG. 3, because the compressible diameter of cable 50 is slightly greater than the greatest arcuate distance between indentations 53 and 54.

The lever sets pivot from pivot pins 59, 60 removably held between spaced framework support members 61, 62 so that the jaw-lever mechanism can be simply released by removal of two pins 59, 60 to simplify maintenance, or replacement of movable parts or jaws, or pivot pins.

The jaws pivot as a unit back and forth axially along the cable 50 axis under force on the ends 69 of levers 57, 58 extending out of the framework housing assembly, as indicated by movement in opposite directions of arrows 63, 64, and as permitted by internally-of-framework-support-members 61, 62-mounted pivot pins 65 to 68. Thus, the extending lever set ends 69 may be considered a manually manipulatable clamp lock or detent that can serve to close the jaws 51, 52 enough to grip cable 50 for the self-tightening action by movement to the left as by arrow 64 or conversely to unlock the grip on the cable 50 by movement to the right as by arrow 63.

The framework housing side support members 61, 62 thereby confine movement of the jaws 51, 52 laterally and permit movement axially about pivot pins 59, 60. Preferably the fitting is snug to give better strength and a residual static-friction between the levers 55, 56, 57, 58 and side support members 61, 62 is desirable to retain the position of lever ends 69 in place resisting axial movement of the jaws in the absence of an overcoming force and thus does not necessitate springs or bias forces.

To keep the lever ends 69 to the right or open position when feeding cable 50 through jaws 51, 52 a lock hinge lever 89 is used. This lever 89 fits into slot 89A to keep jaws 51, 52 in the open position. This permits full attention to handling of cable 50 in feeding through jaws 51, 52 thereby letting the positioning of clamp 35 easily follow in attaching the ratchet jack 36. If a spring is used to bias the jaws to the left in FIGS. 2 and 4, it is hard to feed the bitter end of a cable through the jaws without manually holding lever end 69 to the right as in arrow 63 direction against the spring force.

Since considerable forces may be applied to large cables 50 and it is still desirable to have light weight and portability in these cable clamp units 35, the framework is of relatively thin panels 61, 62, 92 and 93, welded for example to bottom shoe 70. It might be otherwise secured and spaced apart by conventional fasteners, bolts, nuts and braces, etc. This eliminates interference with jaw 51, 52 movement or cable 50 feed therethrough. However, because of the large forces the critical elements are the pivot pins 59, 60 which bear a significant part of the high cable tension forces and thereby tend to break, shear or bend. Thus, the spacer 71 which with levers 55, 56, 57, 58 and support panels 61, 62 fully enclose pivot pins 59, 60 internally between support panels 61 and 62 is a critical feature in operation of the clamp under heavy load conditions. The remaining pivot pins 65 to 68 are also fully enclosed by the jaws and lever sets 55, 56 and 57, 58 to abut internally adjacent side support panels 61, 62 for the same reason.

As seen from FIG. 2, the framework has a pivoted yoke 80 with arms 81 and 82 extending parallel to and alongside support panels 61, 62. Arms 81, 82 are attached to support panels 61, 62 by pins 102, 103 therefore embracing the support panels 61, 62 so that the clamp may be fastened to the ratchet jack 36 by means of eye 47 extending within slot 83 to receive pin 84 inside yoke 80. Pin 84 is anchored by chain 85 to the yoke 80 to keep in readiness for coupling the portable clamp 35 to a tightening jack 36, and thereby serves as a lock for receiving rigging eyelets through the yoke cross member fitting bridging the two arms 81, 82. The arms 81, 82 have a substantially T-shaped cross section with taper 88 extending in the direction opposite the cable tension pull under clamping load. Note that this prevents twist when ratchet torque is applied to the jack 36 which by way of eye 47 and slot 83 applies torque to the arms 81, 82.

Also, side braces 100, 101 exterior to panels 61, 62 support the pivot pins 59, 60 to give added strength to the portable unit without adding substantial weight, and enough cross section support is thus provided that wear or elongation of pin holes is eliminated. The braces 100, 101 similarly support yoke pivot pins 102, 103.

The shoe 70 rests on the barge deck with the jaws upright terminating with lock hinge lever 89. The ends 90, 91 of shoe 70 in the cable axis directions are tapered upwardly toward the jaws, thereby letting the portable clamp rest on the barge deck and move in opposite directions in response to jack 36 tightening or cable 50 tension and ride axially over surfaces such as welds or other low vertical deck protuberances without seizing or catching.

As seen from FIGS. 2 and 3 terminal end cross braces 92, 93 are situated below the cable axis to prevent interference and these are welded to the support panels 61, 62 which in turn are welded to the shoe 70.

The arms 81 and 82 may be welded to support panels 61, 62 rather than pivoted thereon if vertical play in alignment of jack 36 is not required, thereby eliminating yoke pivot pins.

The clamp shown in FIGS. 5 to 7 is the deck clamp which is placed on its side as shown and has two side plate support members 61', 62' with lower side plate 62' welded to the barge deck 95 and opposing support member 61' uppermost. The accessible lever arm end 69' has thereon a hammerhead 96 so that a sledge hammer can be used thereagainst to move it as aforesaid in the directions of arrows 64 for clamping and 63 for unclamping jaws 51, 52. Pivot pins 59 and 60 can be removed through support member 61' so that the jaws and levers are released from the framework.

The hollow cylindrical fairing 98 is provided for guiding the cable for feed through the jaws 51, 52 and more importantly to give a wide angle of cable entry against conical surfaces 99 when the cable is under tension to permit wrapping cables in different patterns around deck fittings, etc. even when the clamp is welded to the deck and can't be moved.

When installed all the locking lever ends 69' accessible outside the support housing should be inboard from the sides of the barge for safety and accessibility for manually forcing into position with a sledge to either lock on a tautened cable or to release the cable from clamping. The low profile attained by mounting on the side is important for safety and keeping the deck clear of tall obstacles.

A typical ratchet jack 36 weighs about 75 pounds (34.1 KG) and can be easily carried by one man. They are standard equipment for rigging barges and obtainable from many supply sources. They come in standard lengths of 24, 30 or 36 inches (61, 76, 91 cm), and have either pelican hooks for attaching to chain links as a fitting on one or both ends, connecting eyes 47 or other special end connector fittings. For example, ratchet pipe turnbuckles are available from C. M. American Division of Columbus McKinnon, McKees Rocks, Pennsylvania 15136, with a selected variety of eyebolts, hooks, clevis jaws, barrels and lengths. Similarly various sorts of deck cable fastener buttons and fittings 25–28, 43, 44, etc. are commercially available standard equipment. An equivalent hydraulic jack could also be used, if desired. When the ratchet jacks 36 are used a pin is welded to the deck of the barge for mating with the eye of a ratchet receiving hook which receives an eye in one ratchet end. The hook permanently secured in place by a keeper plate is welded on top of the pin to let the hook swing 360°. By spacing the hooks appropriately with the usual pairs of deck clamp rigs on a barge location as shown in barges 10 and 11 for example, one hook can be positioned to receive a ratchet 36-portable-clamp 35 assembly for reaching and tightening the bitter ends of two cables 16, 18 or 19, 21.

The tightening procedure by one man for each cable is exemplified by cable 21 on barge 11 of FIG. 1. One bitter end of cable 21 is fed through deck clamp 23N and locked in clamping position by a sledge hammer manually used against the inboard located lock lever extension 96N. Then the cable is wound around deck fitting buttons 43, 44, etc. as tightly as feasible with manual tensioning and fed through deck clamp 23M in the freely passing direction by proper positioning of lock lever 96M.

The eye 45 of jack 36 (which is extended to full length before use) is then secured into deck hook 111 (shown in an exploded position for illustration only) and eye 47 into portable clamp 35 in the manner of FIGS. 2 and 4. Then bitter end 24M is fed into the jaws portable clamp 35 in the freely passing mode so that the jaws will clamp with more force as the ratchet jack is shortened manually by using ratchet handle 112 to tauten the cable 21. The cable 21 is pulled as tightly as manually feasible into the clamp 35 before its locking lever is moved to clamping position. This leaves a free bitter end 24M passing through clamp 35 and is not critical as to length and removes the necessity for chain link fittings or dressings, eyes, loops, etc. on the end of cable 21. As the ratchet tightens cable 21, if the jack span is not sufficient for full tightening on one pass, the jack may be re-extended to full length and a further bite taken up the cable toward deck clamp 96M, so that the range of adjustment of the ratchet is not critical and the tightening proceeds efficiently by a single man effort even to the extent of moving barges 11 and 13 together and squaring them, thus eliminating the need for a tug. After ultimate tension is produced in cable 21 the lock lever 96M is sledged into place to retain the tautness and both ratchet 36 and portable clamp 35 is released for similar operation on one of the other cables.

Also, it is possible to repeat the tightening through the other deck clamp 23N on bitter end 24N in the same manner so that both ends of cable 21 are tautened. Note that the cable 21 thus need not be taken off the fittings and started over if partially fouled.

Preferably the ratchet is a standard $1\frac{3}{8}\times24$ inch ($3.5\times61$ cm) barrel with two eye fittings at opposite ends. This then can be operated either right or left handed by simply reversing ends to get the most convenient mode of operation. The portable clamp 35 weighs approximately 40 pounds (18 KG) and is easily portably carried by a single man. The ratchet 36 with a six foot (1.83 M) cheater (longer levered handle) pipe operated by one man can be used to tension a cable with approximately 38,000 pounds (17,273 KG) which is a desired tautness for use in securing barges together as one single seaworthy unit.

Accordingly, the clamps are preferably designed to handle one inch (2.5 cm) steel cable at such forces since they break at about 84,000 pounds (38,200 KG). The clamps are made of three types steel, namely 1040 mild steel, T-1 steel with 135,000 psi (930,000 KPa) tensile strength made by U.S. Steel Corp. and P17-4 stainless steel with 200,000 psi (1.38 MPa) tensile strength when heat treated at 900° F. for one hour, as made by Armco Steel Corp.

The respective panel parts of the stationary deck clamp of FIGS. 5 to 7 are made of 1040 mild steel plating 1 inch (2.54 cm) thick. The lock and release lever arms are made from T-1 steel. The jaws are non-heat treated P17-4 steel (since they do not bite into the cable properly when too hard) and are $1\frac{1}{2}$ inches (3.81 cm) wide, $2\frac{1}{2}$ inches (6.35 cm) high and $6\frac{1}{2}$ inches (16.5 cm) long with a 63/64 inch (2.5 cm) diameter hole placed with a one-quarter inch (0.64 cm) gap between two adjacent jaws. The removable pins are P17-4 stainless steel heat treated $1\frac{1}{4}$ inch (3.18 cm) diameter and $6\frac{1}{4}$ inches (15.9 cm) long with the internal pins $3\frac{1}{2}$ inches (8.9 cm) long. The hammer head is of 1040 mild steel and is $1\frac{1}{2}$ inches (3.8 cm) wide, $2\frac{1}{2}$ inches (6.35 cm) high and 4 inches (10.16 cm) long and welded between the two extended lever arms to protrude on three sides. Each end plate preferably has a cable feed hole 2 inches (5.08 cm) in back and $1\frac{1}{4}$ inches in front in a diameter aligned axially with the jaw axis, and the spacer 71 is $1\frac{1}{2}$ inches (3.8 cm) wide by 3 inches (7.62 cm) high by 9 inches (22.9 cm) long.

The portable clamp of FIGS. 2 to 4 has similar materials with thinner and lighter (61, 62) auxiliary panels (100, 101) framework and shoe plate (70) panels of $\frac{1}{4}$ inch (0.64 cm) thickness and $\frac{3}{4}$ inch (1.9 cm) diameter pins. The yoke arms 81, 82 are $10\frac{1}{4}$ inches (26 cm) long of one-half inch (1.27 cm) steel with 6 inch (15.25 cm) long T-brace plates 88 and a 1 inch (2.54 cm) thick yoke cross plate brace 3 inches (7.62 cm) wide by $3\frac{3}{4}$ inches (9.5 cm) long with an elongated 1 inch (2.54 cm) by 3 inch (7.62 cm) eye entry hole. The yoke arms 81 and 82 pins 102, 103 are 1 inch in diameter by 1 inch long.

From the foregoing specification it is evident that this invention provides novel methods and apparatus which has abandoned the state of the art and accordingly the appended claims define those features of novelty with particularity that illustrate the nature and spirit of the invention.

What is claimed is:

1. The method of drawing and binding two barges together by tightening a cable with at least one bitter end comprising the steps of securing one end of the cable to the deck of a barge, wrapping the cable around fittings on said two barges to bind them together, attaching a portable clamp to the unsecured bitter end of the cable, securing a movable jack temporarily to a fixed object on the deck of a barge and the clamp, tightening the cable by means of said jack to draw and bind the two barges together, clamping the tightened cable in place on a barge deck and removing the portable clamp and jack from the cable and deck for use elsewhere.

2. The method defined in claim 1 including the steps of affixing a cable of arbitrary length to two fittings to be bound tautly together, and clamping the tightened cable in place by a clamp device permitting the cable to pass through in a cable tightening direction and to clamp in the cable loosening direction with more force as the tautness of the cable increases.

3. The method defined in claim 1 including the steps of (1) employing as said portable clamp means permitting the cable to pass freely through in one direction and clamping in the opposite direction with more force as the force on the cable increases, and (2) releasing the jack and removing the portable clamp after the tightened cable is clamped in place by unclamping the portable clamp from the cable, and passing the portable clamp freely over the corresponding bitter end of the cable.

4. The method of coupling two objects together by means of a cable, comprising the steps of affixing to at least one object unilateral cable clamping means which permits the cable to pass freely therethrough in a single direction, clamping a length of cable in said clamping means to extend therethrough, thereby securing the cable from travel through the clamping means in the opposite direction tightening the cable between said two objects to a predetermined tension by gripping a portion of said cable extending through said clamping means with a further similar clamping means, affixing a jack to the further clamping means for moving it and the cable therewith in a direction tautening the cable, and tightening said cable tension between said two objects by means of said jack to move said cable in a direction opposite said single direction to clamp the cable in said further clamping means for movement therewith, whereby the length of the cable is not critical because opposite ends are passed through the respective clamps.

5. Cable clamp apparatus comprising a set of movable cable clamping jaws substantially rectilinear in form and pivoted to reciprocally move in a generally axial direction of a cable passed therethrough thereby to open and close on a cable of predetermined size in opposed axial movement directions, a framework comprising two spaced apart support members holding said jaws and pivot pins about which said jaws are pivoted with the pivot pins removably in place, a pivot mechanism movable with said jaws about said pivot pins comprising forward and rearward lever sets with levers on opposite sides of the jaws, accessible extensions from one lever set extending outside said framework to selectively forceably move the pivoting mechanism in said axial movement directions, and a spacer between the two support members fully enclosing said pivot pins therebetween while permitting pivoting movement of the levers about the pivot pins between said support members.

6. Cable clamp apparatus as defined in claim 5 having one said support member substantially planar and affixed to a solid object.

7. Apparatus as defined in claim 6 wherein the support member is welded to the deck of a barge with said pivot pins removable through the opposing said support member which is thereby uppermost.

8. Apparatus as defined in claim 7 wherein the jaws and lever sets are released from said support member by removal of the pivot pins.

9. Apparatus as defined in claim 5 including a hollow cylindrical fairing attached to said framework in axial registration with said jaws to guide a cable passed therethrough and having a conical interior surface tapered away from the framework thereby to permit feeding the cable into said jaws from a substantial angle from the axis of the cable passing through the jaws.

10. Apparatus as defined in claim 5 having a substantially planar shoe bridging the two support members and extending axially in the cable axis direction, wherein said shoe has the opposed axial ends thereof inclined toward the jaws, thereby permitting the apparatus to ride axially over surfaces with low vertical protuberances thereon.

11. Apparatus as defined in claim 5 wherein the framework holds the movable jaws close to the support members to present a static frictional force resisting axial movement of said jaws.

12. Apparatus as defined in claim 5 provided with a pivoted yoke having two extending arms embracing the spaced apart support members to axially extend in one said axial direction from the framework.

13. Apparatus as defined in claim 12 wherein said yoke has a fitting bridging said arms adaptable to receive and lock rigging eyelets.

14. Apparatus as defined in claim 12 wherein said extending arms are substantially T-shaped in cross section.

* * * * *